United States Patent [19]

Kurt et al.

[11] Patent Number: 4,576,026

[45] Date of Patent: Mar. 18, 1986

[54] CYLINDER LOCK HAVING COUPLING MEANS

[75] Inventors: Prunbauer Kurt, Herzogenburg; Erich Csapo, Vienna, both of Austria

[73] Assignee: EVVA-Werk Spezialerzeugung von Zylinder- und Sicherheitsschloessern Gesellschaft m.b.H. & Co. Kommanditgesellschaft, Vienna, Austria

[21] Appl. No.: 653,913

[22] Filed: Sep. 24, 1984

[30] Foreign Application Priority Data

Oct. 18, 1983 [AT] Austria ..... 3714/83

[51] Int. Cl.[4] ..... E05B 17/04

[52] U.S. Cl. ..... 70/380; 70/DIG. 42

[58] Field of Search ..... 70/379 R, 379 A, 380, 70/372, DIG. 42

[56] References Cited

U.S. PATENT DOCUMENTS 2,462,827 2/1949 Feldmann ..... 70/379 R

FOREIGN PATENT DOCUMENTS 69676 12/1975 Australia ..... 70/380

2059491 4/1981 United Kingdom ..... 70/380

*Primary Examiner*—Robert L. Wolfe

*Attorney, Agent, or Firm*—Michael J. Striker

[57] ABSTRACT

A cylinder lock is provided with a coupling device connectable via a locking beam to an additional lock structure. The locking device comprises a coupling sleeve slidably mounted on an end portion of the cylinder core. The coupling sleeve is formed with an elongated radial recess engaging a radially directed snap pin in the cylinder core so that the core is rotatable over the length of the radial slot without carrying the coupling sleeve. The coupling sleeve is also formed with a bore for engaging in another angular position of the cylinder core the snap pin so that the coupling sleeve is jointly rotatable with the cylinder core. The coupling sleeve has an end wall having a central cross-shaped recess for receiving in a selected position a flattened end portion of the locking beam.

4 Claims, 4 Drawing Figures

CYLINDER LOCK HAVING COUPLING MEANS

BACKGROUND OF THE INVENTION

The present invention relates in general to cylinder locks and in particular to a cylinder lock having a cylinder core provided with a coupling device for transferring the rotary movement of the cylinder core to an additional locking member.

Cylinder locks provided with coupling devices in the form of a coupling sleeve slidably mounted on a free end portion of the cylinder core for engaging a locking member, are used particularly in connection with turn knobs such as used commonly in America. This invention is concerned particularly with the arrangement of a locking shaft on the inner end of the cylinder core. This locking shaft serves for transmitting the rotary movement of the core of the cylinder to the turn knob and to a corresponding mechanical locking bolt. The cylinder lock of this invention operates in conventional manner with the aid of simple or multiple segmented pin tumblers but in principle also a different kind of locking mechanism can be used.

The aforementioned locking shaft is usually in the form of a flat metal rod which at one end is bent or bulged. The bent portion or the bulge engages into a slot of a plate which is connected by an annular nut to the coupling end portion of the cylinder core. For this purpose it is necessary that the coupling end of the cylinder core be provided with an outer thread so as to engage the inner thread of the annular nut. Moreover, a snap pin must be provided in order to hold the annular nut in position. The annular nut also performs the function of protecting the cylinder core against removal from the lock housing. This function however due to limitations of material strength of the nut, is performed only imperfectly. The machining of a thread on the coupling end of the cylinder core and the provision of the corresponding annular nut makes the manufacture of the prior art cylinder locks of this kind expensive and disadvantageous.

Furthermore, in conventional constructions of the cylinder locks of this kind it has been necessary to modify the coupling component parts such as the locking shafts so as to enable the installation in connection with different designs of turn knob locks. Depending on the kind of the employed turn knob or locking cylinder, the locking shaft must be arranged either in a horizontal or in a vertical position. In many types of cylinder locks it is also necessary to provide an idling motion for the cylinder core so that the rotary movement of the locking shaft amounts to 180° for example when the cylinder core is rotated about 360° (in order to enable the withdrawal of a key from the cylinder core after the completion of its rotary movement). For different settings of the cylinder core it has been known to stamp in the end face of the aforementioned annular nut toothlike recesses for engaging a springbiased snap pin provided on the cylinder core. The snap pin in this prior art arrangement fixes the annular nut in its angular position and serves as a stop member for the bent portion of the locking shaft. The provision of such stamped recesses however is also expensive in manufacture and makes the entire construction of the lock more complicated.

SUMMARY OF THE INVENTION

It is therefore a general object of the present invention to overcome the aforementioned disadvantages.

More particularly, it is an object of the invention to provide an improved cylinder lock whose coupling mechanism to the locking beam or shaft is simple and inexpensive for manufacture.

Another object of this invention is to provide such an improved cylinder lock whose adjustment to different designs of turn knobs and to different locking bolds is very simple, and without the need of separate structural parts.

An additional object of this invention is to provide such an improved cylinder lock having a more advantageous safety means against removal of the cylinder core from the lock housing.

In keeping with these objects and others which will become apparent hereafter, one feature of the invention resides, in a cylinder lock having a housing, a cylinder core supported in the housing for rotation about an axis, and a coupling device for transmitting the rotary movement of the cylinder core to an additional locking member, in a combination which comprises a radial bore in an end portion of the cylinder core, a spring-biased snap pin in the radial bore, a coupling sleeve arranged on the end portion of the cylinder core, an elongated slot formed in a circumferential portion of the sleeve in the range of the snap pin, the snap pin projecting into the slot to permit an angular displacement of the cylinder core relative to the sleeve over the length of the slot, a bore formed in the sleeve in the range of the snap pin, the pin being selectively engageable with the bore to rotate the sleeve jointly with the cylinder core, and a locking beam connected to the sleeve to transmit the rotary movement of the cylinder core to the additional locking member.

In the preferred embodiment of this invention, the length of the elongated slot is dimensioned such as to permit a relative angular displacement about 180° between the cylinder core and the coupling sleeve. According to another feature of this invention, the coupling sleeve has an end wall provided with a cross shaped recess and the locking shaft having a flattened end portion which is insertable into the cross shaped recess in two angular positions differing by 90°.

According to still another feature of this invention, the cylinder core is held in its axial position in the lock housing by a retainer ring resiliently engaging a groove in the cylinder core.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
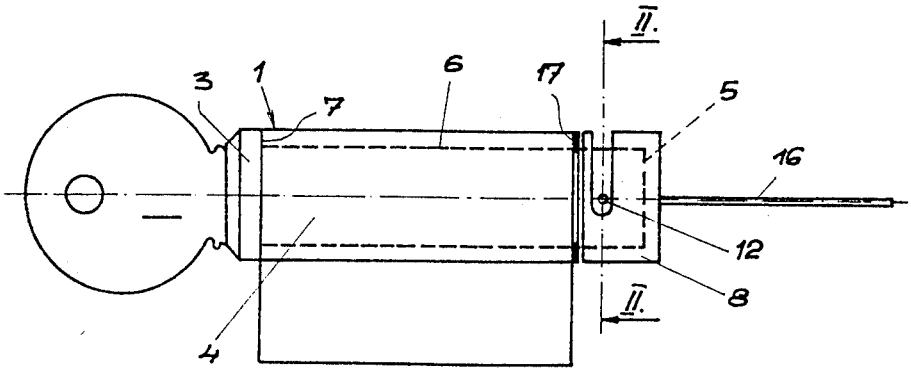
FIG. 1 is a side view of a cylinder lock according to this invention.

FIG. 1 illustrates in a side view a cylinder lock of this invention with an inserted key 2. A cylinder core 3 is supported for rotation in a bore 6 in a cylinder housing 4. The coupling end portion 5 of the cylinder 3 extends beyond the end wall of the housing 4. The opposite outer end of the cylinder core 3 is formed with a flange 7 slidably engaging the front wall of the cylinder housing 4 whereas the coupling end 5 is provided with a groove for receiving a retainer ring 17 engaging the rear wall of the cylinder housing. The retainer ring guarantees that the cylinder core cannot be forcibly removed from the lock housing. This safety measure by means of a retainer ring has proved reliable and inexpensive. However, it is also possible to employ different safety means such as for example a safety bolt arranged in a radial through bore in the cylinder core.

After the insertion of a correct key the cylinder core 3 can be rotated about its center axis in the bore 6 of the cylinder housing. The locking elements such as pin tumblers, magnetic tumblers and the like are of conventional construction well known in the art and therefore need not be further described.

Figure 2:
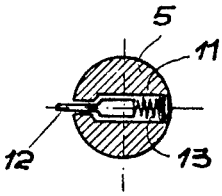
FIG. 2 is a sectional rear view of the cylinder core of FIG. 1, taken along the line II—II.
Figure 3:
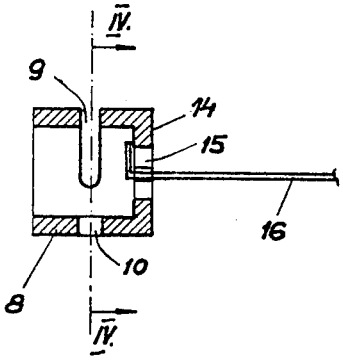
FIG. 3 is a sectional side view of a coupling sleeve taken along the line III—III in FIG. 4.
Figure 4:
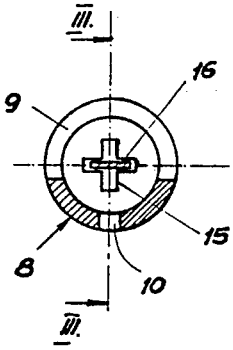
FIG. 4 is a sectional view of the coupling sleeve taken along the line IV—IV in FIG. 3.

According to this invention, a coupling sleeve 8 is inserted on the coupling end 5 with sufficient play to guarantee free rotation of the two components parts relative to one another. The coupling sleeve 8 is formed with a radial slot 9 extending in a plane II—II over a circumferential portion of the coupling sleeve 8. In the same plane II—II the coupling sleeve 8 is provided with a radial bore 10 situated opposite the circumferential slot 9 (FIGS. 3 and 4). The coupling end 5 is formed with a radially directed stepped bore 11 (FIG. 2) in which a spring biased snap pin 12 is accommodated. The snap pin has an enlarged base which is in engagement with the biasing spring 13 so that in the rest position of the pin the base is seated on the step of the bore and the pin projects above the surface of the core 5. Depending on the desired application of the coupling device, the pin 12 either projects into the radial slot 9 or into the bore 10. In either position the coupling sleeve 8 is held in a fixed axial position.

If the coupling sleeve 8 is oriented relative to the cylindrical core in such a manner that the pin 12 projects into the radial slot 9, thus permitting a no-load or disengaged rotation of the cylinder core relative to the coupling sleeve 8. The cylinder core 3 can be freely rotated about 180° until the snap pin 12 abuts against one of the two ends of the elongated radial slit 9. Only at this point of the rotary motion of the cylinder core the coupling 8 is entrained by the snap pin to complete the 360° rotation of the cylinder core. In other words, in rotating the cylinder core about 360° the coupling sleeve 8 and consequently the locking beam 16 make a rotation by 180° only. This reduction of the rotary motion is necessary in many types of cylinder locks in order to influence the locking or unlocking action. On the other hand, in the cylinder lock according to this example, it is necessary to perform a complete 360° rotation of the cylinder core inasmuch as the key can be withdrawn from the core only at the end of a complete turn.

Alternatively, the coupling sleeve can be firmly connected to the coupling end 5 of the core by inserting the snap pin 12 in the bore 10. In this manner the coupling sleeve rotates jointly with the cylinder core in both directions of rotation. For certain types of cylinder locks, this joint rotation is necessary.

The desired mode of connection between the coupling end 5 and the coupling sleeve 8 is easily adjusted by depressing the snap pin 12 in its bore 11 and changing the angular position of the coupling sleeve relative to the core. The outer end of the coupling sleeve 8 is closed by an end wall 14 which is provided at its center with a cross-shaped slot 15. The locking beam 16 is inserted either into the horizontal or vertical arm of the cross-shaped recess so that the rotary motion of the cylinder core or of the coupling sleeve by transmitted to a non-illustrated additional lock structure. The end of the locking beam 16 is bent at right angles and the resulting hook like torsion engages the inner wall of the end wall 14. Consequently, when snap pin 12 engages one of the slots in the coupling sleeve 8, the locking beam 16 cannot be removed from the sleeve.

It will be understood that each of the elements described above, or two or more together, may also find a useful application in other types of constructions differing from the types described above.

For example, the locking beam 16 can be anchored to the cross-shaped recess in the end wall of the sleeve by means of a thickened or bulging end portion instead of the hook. Also the elongated slot 9 in the sleeve 8 can extend over an angle different from 180°.

While the invention has been illustrated and described as embodied in a specific example of a coupling device for a cylinder lock, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A cylinder lock having a housing, a cylinder core supported in the housing for rotation about an axis, and a coupling device for transmitting the rotary movement of the cylinder core to an additional lock structure, the coupling device comprising a radial bore in a free end portion of the cylinder core; a spring biased snap pin arranged in the radial bore; a coupling sleeve slidably mounted on the free end portion of the core; a radial slot formed in a circumferential portion of the sleeve to engage in an angular position of the sleeve the snap pin and to permit a free angular displacement of the cylinder core relative to the sleeve over the length of the radial slot; a bore formed in the sleeve to engage in another angular position of the cylinder core the snap pin and connect the coupling sleeve for joint rotation with the cylinder core; and a locking beam connected to the coupling sleeve for rotation about said axis.

2. A coupling device as defined in claim 1, wherein the length of the radial slot in the coupling sleeve is dimensioned such as to permit a relative rotation about 180° between the cylinder core and the coupling sleeve.

3. A coupling device as defined in claim 1, wherein the coupling sleeve is provided with an end wall formed with a cross-shaped recess defining two intersecting slots, said locking shaft having a flattened end portion bent at right angles, said end portion being selectively insertable in one of the slots of the cross-shaped recess.

4. A coupling device as defined in claim 1, wherein the free end of the cylinder core projects beyond the housing, and further comprising a retainer ring snap engaging the cylinder core between the housing and the coupling sleeve.

* * * * *